US007743458B1

(12) United States Patent
Moore et al.

(10) Patent No.: US 7,743,458 B1
(45) Date of Patent: Jun. 29, 2010

(54) COLLAPSIBLE BROOM AND DUSTPAN

(75) Inventors: Anthony D. Moore, Summerfield, NC (US); Bruce A. Angel, Kernersville, NC (US)

(73) Assignee: Camco Manufacturing, Inc., Greensboro, NC (US)

( * ) Notice: Subject to any disclaimer, the term of this patent is extended or adjusted under 35 U.S.C. 154(b) by 0 days.

(21) Appl. No.: 12/548,632

(22) Filed: Aug. 27, 2009

Related U.S. Application Data

(63) Continuation of application No. 11/043,210, filed on Jan. 26, 2005, now Pat. No. 7,600,287.

(51) Int. Cl.
*A47L 13/52* (2006.01)

(52) U.S. Cl. ..... 15/257.2; 15/144.1; 15/144.4; 15/172

(58) Field of Classification Search ..... 15/144.1, 15/144.4, 172, 257.2
See application file for complete search history.

(56) References Cited

U.S. PATENT DOCUMENTS 5,661,868 A * 9/1997 Panagakos et al. ..... 15/184
6,256,829 B1 * 7/2001 Hatch et al. ..... 15/144.4
2005/0071943 A1 * 4/2005 Liu ..... 15/257.2

* cited by examiner

*Primary Examiner*—Randall Chin

(57) ABSTRACT

A collapsible broom and dustpan provide convenient, compact storage for use in RVs, mobile homes, efficiency apartments and the like with limited closet and storage space. The broom includes a standard telescoping handle which is affixed to a pivot joint on the broom head. The handle can be extended and rotated to a variety of selected angles. Tabs on the locking member within the pivot joint engage the handle girdle which surrounds the locking member. The locking member is spring loaded to maintain the handle at a desired position. The dustpan includes a handgrip which will accommodate the broom handle while the dustpan tray receives the broom head for compact storage. C-shaped clamps within the grip and a catch within the dustpan tray hold the broom within the dustpan until manually released therefrom.

12 Claims, 4 Drawing Sheets

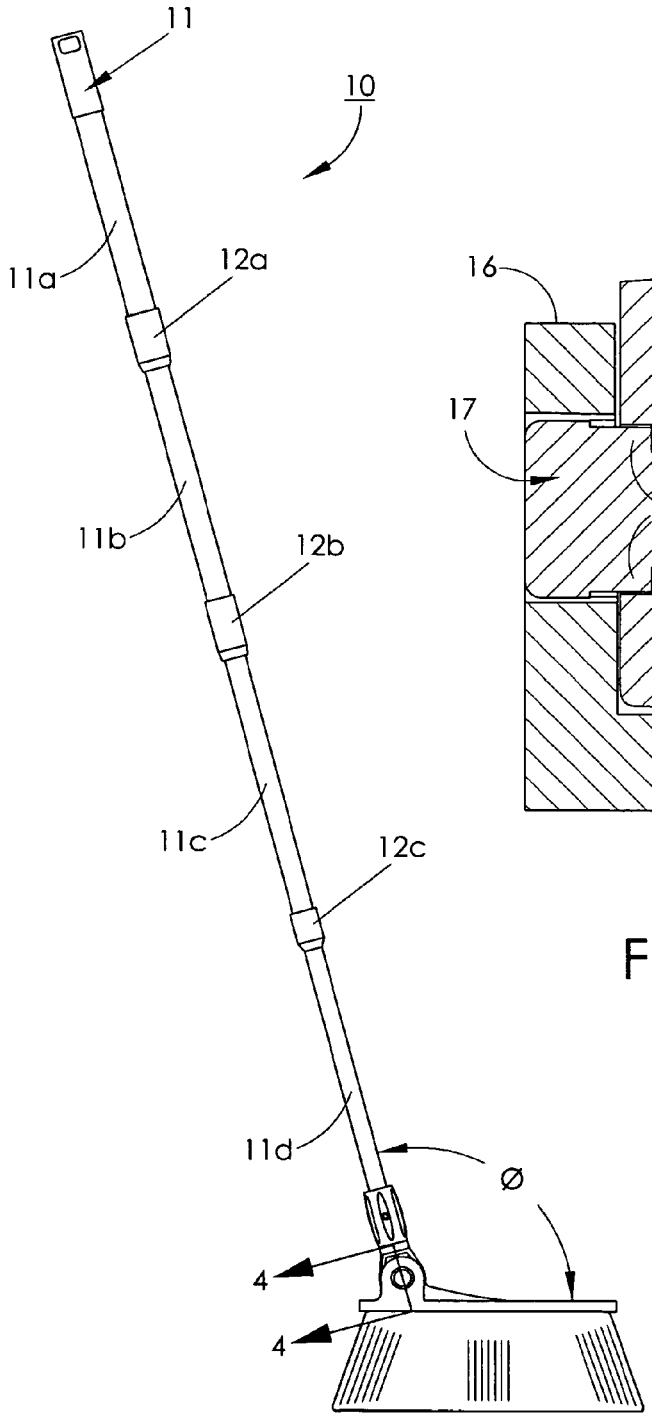
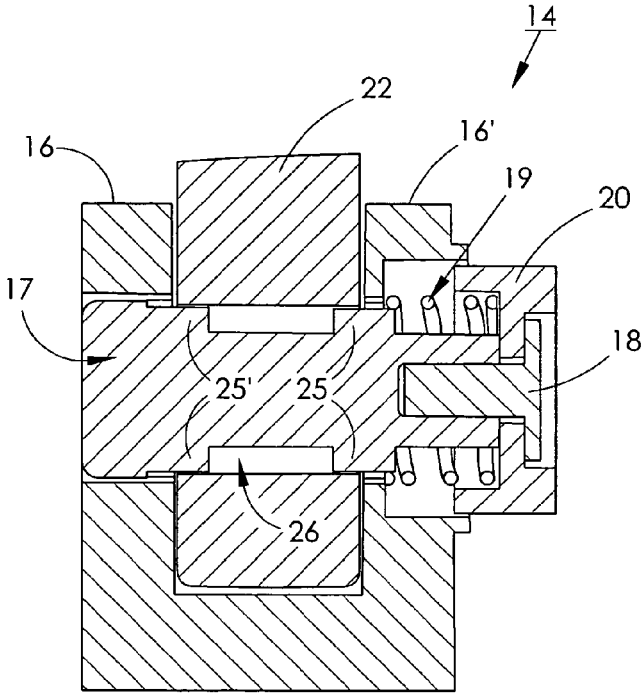
FIG. 4
FIG. 3

COLLAPSIBLE BROOM AND DUSTPAN

This is a continuation of and claims benefits under prior application Ser. No. 11/043,210 filed 26 Jan. 2005, now U.S. Pat. No. 7,600,287

FIELD OF THE INVENTION

The invention herein pertains to cleaning and maintenance tools and particularly pertains to a broom which is collapsible and can be stored with a dustpan in compact fashion during periods of nonuse.

DESCRIPTION OF THE PRIOR ART AND OBJECTIVES OF THE INVENTION

In recent years the growth of the recreational vehicle (RV) and camping industries has spurred the development of many products peculiar thereto. Campers, mobile homes, RVs and other vehicles each have limited closet and storage space. As a result, standard cleaning equipment such as brooms are often stored exposed in inconvenient areas due to the handle length. Thus, in view of the problems and disadvantages of storing such conventional maintenance equipment in campers, recreational vehicles and in other areas with limited space, the present invention was conceived and one of its objectives is to provide a broom which can be greatly reduced in length for storage purposes.

It is another objective of the present invention to provide a broom having a collapsible, telescoping handle which can be easily retracted, rotated and extended as needed.

It is also an objective of the present invention to provide a collapsible broom which will nest in the removable dustpan for compact convenient storage.

It is still a further objective of the present invention to provide a collapsible broom having a handle which is pivotally attached to the broom head for selective positioning therewith.

It is yet another objective of the present invention to provide a collapsible broom having a pivot joint on the broom head for manual adjustment of the handle as required.

Various other objectives and advantages of the present invention will become apparent to those skilled in the art as a more detailed description is set forth below.

SUMMARY OF THE INVENTION

The aforesaid and other objectives are realized by providing a collapsible broom having a standard, telescoping handle. The handle can thus be extended and retracted as desired along its four (4) sections. The distal end of the handle includes a girdle in a pivot joint which engages a cylindrical locking member. The locking member passes through a pair of ears affixed to the base of the broom head. The girdle, locking member and ears form a pivot joint which allows the handle to selectively rotate into parallel alignment with the head for compact storage purposes. When the broom is used for sweeping the handle is rotated through the pivot joint to an angle of approximately one hundred five degrees (105°) from the broom head. The pivot joint includes a coil spring which surrounds the locking member. The locking member includes two (2) pairs of locking tabs which engage keyways in the girdle and ears in selective fashion to maintain the desired position of the handle in relation to the broom head. To change the handle angle to the broom head the locking member is urged outwardly by applying finger pressure to the locking pin. The finger pressure compresses the spring between one of the ears and the spring retainer which allows the tabs on the locking member to escape the keyways. Once the tabs disengage the girdle and ear keyways the handle is free to rotate in the pivot joint to a desired position where the locking tabs engage a different keyway in the ears and are locked therein by the force of the resilient coil spring.

To store the combination broom and dustpan, the broom handle first is collapsed and rotated as described above into a position parallel with the base of the broom head. The broom so configured is placed within the dustpan which comprises a tray and a handgrip having a channel. The broom head is placed within the tray whereby a catch in the tray engages the lower end of the handle while clamps within the channel of the handgrip engage the handle to provide a secure condensed broom and dustpan which can be easily stored on a closet shelf, in a cabinet or other small area.

BRIEF DESCRIPTION OF THE DRAWINGS

FIG. 3 pictures the broom of FIG. 1 with the handle fully extended and pivoted from the head as for use in sweeping;

FIG. 4 depicts an enlarged cross-sectional view of the locked pivot joint as seen along lines 4-4 in FIG. 3;

DETAILED DESCRIPTION OF THE PREFERRED EMBODIMENT AND OPERATION OF THE INVENTION

Figure 1:
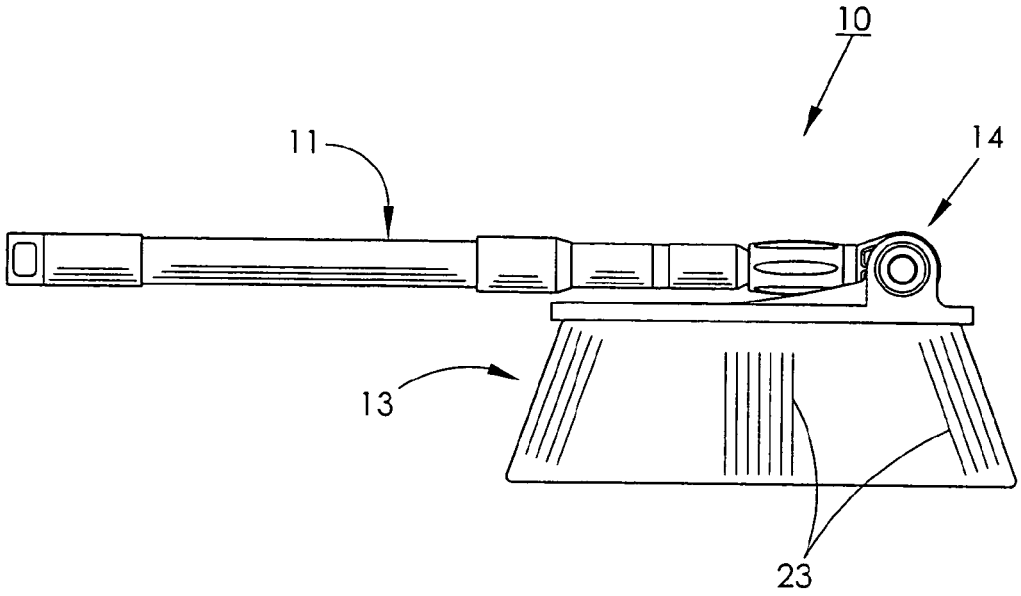
FIG. 1 shows a right side elevational view of the preferred form of the broom with the handle collapsed and folded into parallel relation with the broom head.
Figure 2:
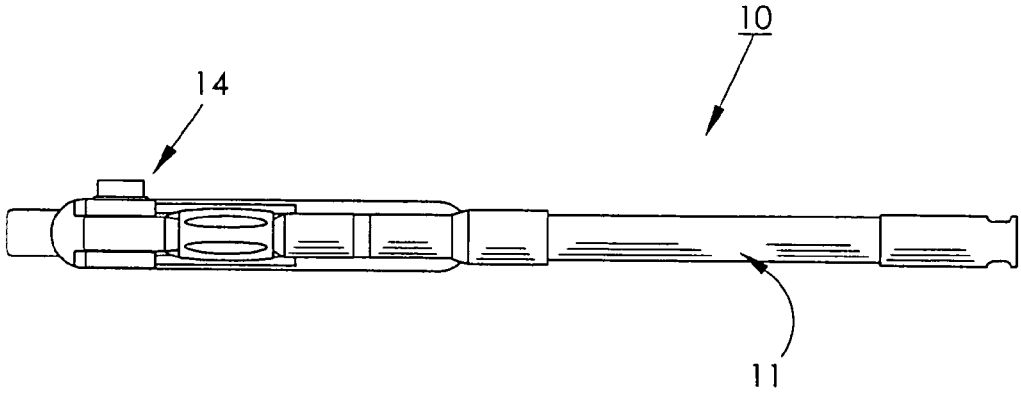
FIG. 2 illustrates a top plan view of the broom as shown in FIG. 1.

For a better understanding of the invention and its operation, turning now to the drawings, FIG. 1 illustrates a right side view of preferred collapsible broom 10 as seen with conventional telescoping handle 11 in a retracted posture and pivoted closed with handle 11 parallel to elongated broom head having multiple bristles 23. Handle 11 is selectively rotatable through pivot joint 14 also seen in FIG. 2 in a top view. Conventional handle 11 is tubular in shape and includes a plurality of four (4) sections (11*a*-11*d*) as seen in FIG. 3. Positioned along handle 11 are standard collars (12*a*-12*c*), each rigidly formed to handle sections 11*a*-11*c* respectively. Collars 12*a*-12*c* can each be rotated clockwise to prevent retraction or allow for extension of sections 11*a*-11*d* as is standard in the trade. Clockwise rotation of collar 12*a* with handle section 11*a*, as seen in FIG. 3, locks handle section 11*a* in an extended posture with handle section 11*b*. Handle section 11*b* can then be rotated in a clockwise direction to lock handle sections 11*b* and 11*c* to prevent relative movement therebetween. Counterclockwise rotation of collar 12*a* and handle section 11*a* for example disengages handle section 11*a* from handle section 11*b* to allow sections 11*a* and 11*b* to telescope as needed.

Figure 6:
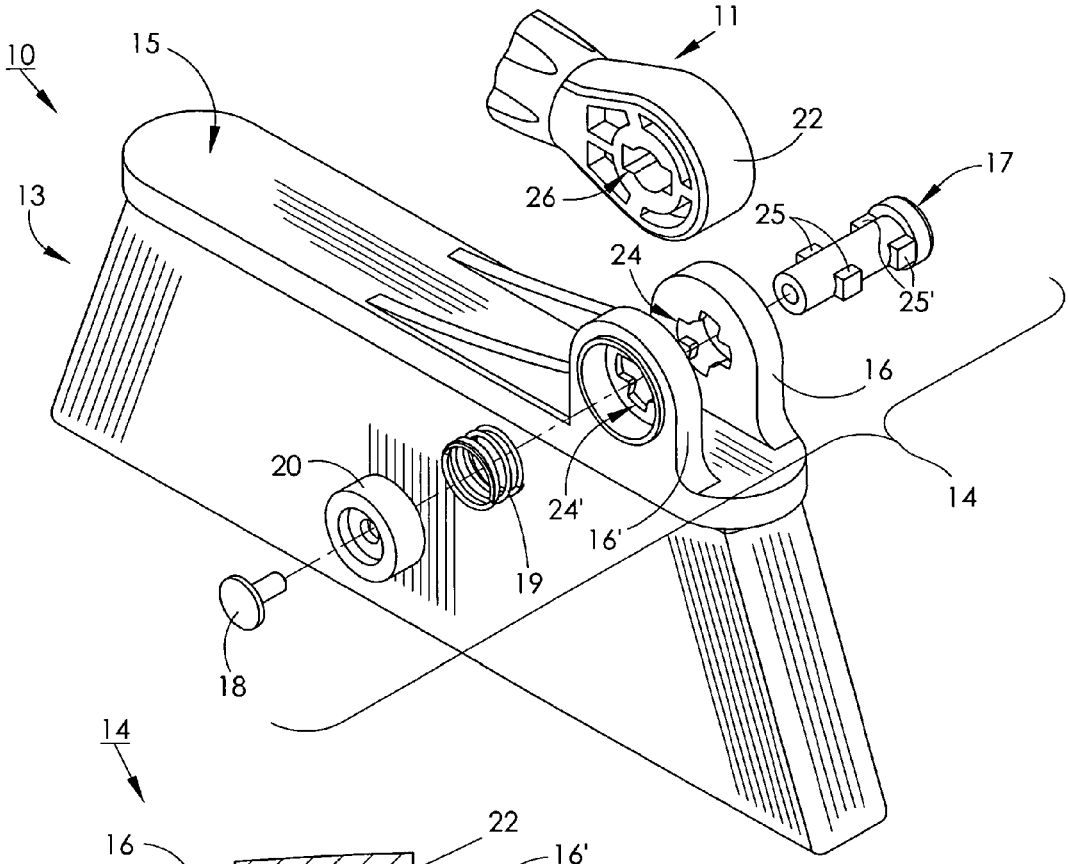
FIG. 6 shows the pivot joint in an exploded fashion to detail the components thereof.

Pivot joint 14 as seen in FIG. 6 includes ears 16, 16' integrally formed with base 15 and each defining indents 27, 27' and keyways 24, 24' respectively. Cylindrical locking member 17 includes knob 17*a*, shaft 17*b* and biasing tabs 25, 25'.

Figure 5:
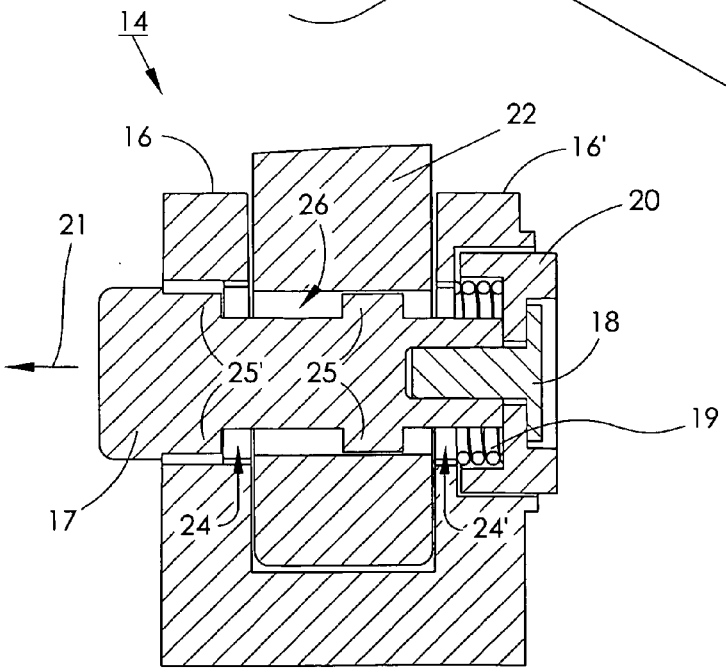
FIG. 5 demonstrates the pivot joint as in FIG. 3 but with the locking member urged inwardly to allow the handle to freely rotate.

Locking member 17 passes through keyways 24, 24' in ears 16, 16', and girdle 22 of handle 11 where it is secured therein by locking pin 18. Locking pin 18 is frictionally engaged within locking member 17 and secures spring retainer 20 therebetween as shown in FIGS. 4 and 5. Coil spring 19 is located between spring retainer 20 and ear 16' and surrounds shaft 17*b* of locking member 17 as seen in FIG. 6. Resilient coil spring 19 prevents rotation of girdle 22 by biasing tabs 25, 25' of locking member 17 in keyway 26 of girdle 22 as seen in FIG. 4. Thus, girdle 22 can be released, rotated and re-engaged in pivot joint 14 so handle 11 is in an upright posture as shown in FIG. 3 by angle ø, approximately one hundred and five degrees (105°) from its collapsed position (FIG. 1). Handle 11 is positioned at zero degrees (0°) in FIG. 1 and can thereafter be raised to angle ø for normal sweeping as seen in FIG. 3. Tabs 25, 25' engage girdle keyway 26 as seen in FIG. 4 and ear keyways 24, 24' to lock handle 11 in a desired posture, such as in FIGS. 1 and 3. In the preferred form of collapsible broom 10, girdle keyway 26 accepts locking tabs in a longitudinal direction relative to handle 11, whereas ear keyways 24, 24' accept locking tabs 25, 25' in either a vertical or horizontal direction to lock handle 11 at zero degrees (0°) or about one hundred and five degrees (105°). Other forms of the invention may have additional keyways as desired for locking handle 11 at other angles (not shown).

In use, finger pressure is axially applied to locking pin as seen in FIG. 5 thereby compressing spring 19 between spring retainer 20 and ear 16' while moving locking member 17 in an outwardly direction as shown by arrow 21. This outward movement releases tabs 25, 25' of locking member 17 from keyways 24, 24' in ears 16, 16' allowing girdle 22 of handle 11 to rotate through pivot joint 14 to another desired position.

Figure 7:
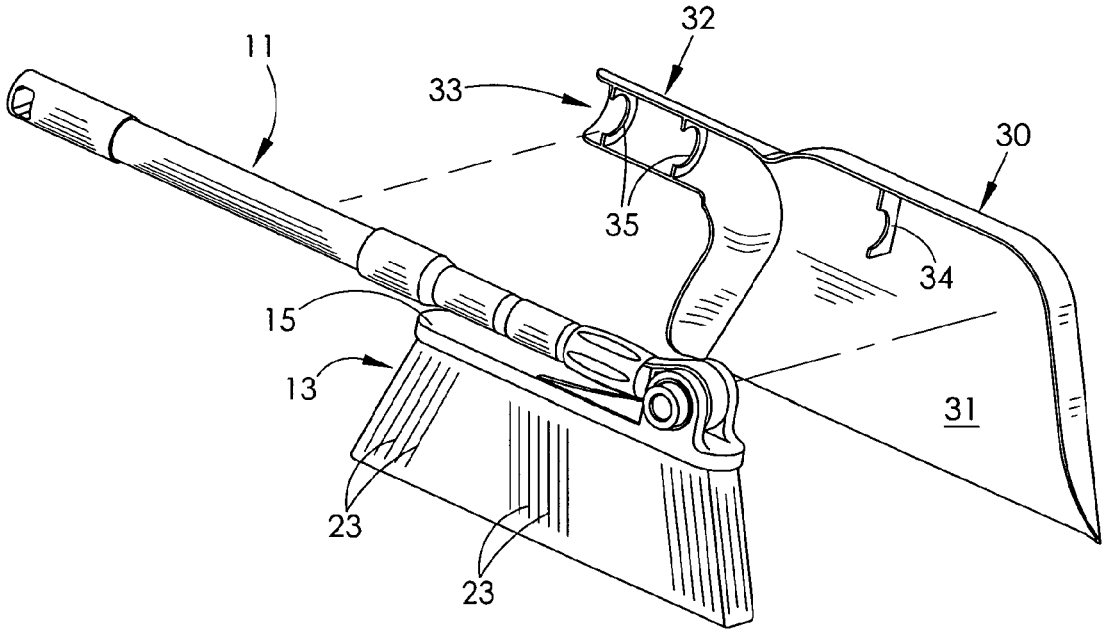
FIG. 7 shows the combination broom and dustpan with the broom in a collapsed manner as in FIG. 1, and exploded from engagement with the dustpan.

In FIG. 7 broom 10 is shown in a collapsed posture with head 13 containing conventional nylon bristles 23. Preferred dustpan 30 is preferably molded from suitable polymeric materials such as polypropylene although other materials may be used and includes tray 31 with hand grip 32 laterally affixed thereto. Hand grip 32 includes channel 33 which communicates with tray 31. As further shown, catch 34 molded within tray 31 engages handle 11 whereas c-shaped clamps 35 molded in channel 33 also engage handle 11 for security purposes. Catch 34 and clamps 35 each include an arcuate opening to frictionally engage handle 11. Handle 11 is thus securely held by catch 34 and clamps 35 and is also allowed to be manually removed therefrom as needed.

The illustrations and examples provided herein are for explanatory purposes and are not intended to limit the scope of the appended claims.

The invention claimed is:

1. A collapsible broom assembly comprising: a telescoping handle, a girdle, said girdle affixed to said handle, a head, a multiplicity of bristles, said bristles attached to said head, a pair of ears, said pair of ears affixed to said head, said girdle rotatably contained between said pair of ears, a dust pan, said dust pan comprising a tray, a grip, said grip attached to said tray, a handle catch, said handle catch mounted on said tray whereby said head rests within said tray with said handle catch engaging said handle.

2. The collapsible broom assembly of claim 1 wherein said grip defines a channel, said grip channel in communication with said tray.

3. The collapsible broom assembly of claim 2 wherein said handle catch is aligned with said grip channel.

4. The collapsible broom assembly of claim 1 wherein said dust pan comprises a polymeric material.

5. The collapsible broom assembly of claim 1 wherein said grip is laterally disposed to said tray.

6. The collapsible broom assembly of claim 1 wherein said handle catch defines an arcuate opening for frictional engagement with said handle.

7. The collapsible broom assembly of claim 1 further comprising a locking member, said locking member comprising a shaft, a knob, said shaft attached to said knob, said pair of ears and said girdle each defining a keyway, said locking member positioned through said pair of ears and said girdle keyways whereby said handle is rotatable to a selected position as said girdle rotates between said pair of ears.

8. The collapsible broom assembly of claim 7 further comprising a locking pin, said locking pin attached to said shaft.

9. A collapsible broom assembly comprising: a telescoping handle, a girdle, said girdle affixed to said handle, a head, a multiplicity of bristles, said bristles attached to said head, a pair of ears, said pair of ears affixed to said head, said girdle rotatably contained between said pair of ears, a dust pan, said dust pan comprising a tray, a lateral grip, said lateral grip attached to said tray, said lateral grip defining a channel, said handle contained within said channel whereby said head rests within said tray with said lateral grip engaging said handle.

10. The collapsible broom assembly of claim 9 wherein said lateral grip channel is in communication with said tray.

11. The collapsible broom assembly of claim 9 further comprising a catch, said catch affixed to said dust pan.

12. The collapsible broom assembly of claim 9 further comprising a locking member, said locking member comprising a shaft, a knob, said shaft attached to said knob, said pair of ears and said girdle each defining a keyway, said locking member positioned through said pair of ears and said girdle keyways whereby said handle is rotatable to a selected position as said girdle rotates between said pair of ears.

* * * * *